United States Patent [19]

Zwart

[11] Patent Number: 4,883,121

[45] Date of Patent: Nov. 28, 1989

[54] DOWNHOLE LOCK ASSEMBLY

[75] Inventor: Klaas Zwart, Peterculter, Scotland

[73] Assignee: Petroline Wireline Services Limited, Scotland

[21] Appl. No.: 215,331

[22] Filed: Jul. 5, 1988

[30] Foreign Application Priority Data

Jul. 7, 1987 [GB] United Kingdom ..... 8715967

[51] Int. Cl.[4] ..... E21B 23/02

[52] U.S. Cl. ..... 166/217; 166/381

[58] Field of Search ..... 166/217, 216, 208, 381, 166/382

[56] References Cited

U.S. PATENT DOCUMENTS

| | | | |
|---|---|---|---|
| 3,051,243 | 8/1962 | Grimmer et al. | 166/217 |
| 3,507,329 | 4/1970 | Stone, Jr. | 166/217 |
| 3,593,784 | 7/1971 | Brown | 166/217 |
| 4,295,528 | 10/1981 | Carmody | 166/381 |
| 4,583,591 | 4/1986 | Krause, Jr. et al. | 166/382 |
| 4,745,974 | 5/1988 | Higgins | 166/217 |

*Primary Examiner*—Jerome W. Massie, IV
*Assistant Examiner*—Terry Lee Melius
*Attorney, Agent, or Firm*—Lalos & Keegan

[57] ABSTRACT

The downhole lock assembly comprises a lock mandrel (10) connected to a running tool (11). The running tool holds an inner mandrel (13) located within the lock mandrel (10) in a position which allows lock-out keys (20) of the lock mandrel (10) to remain within the outside diameter of the lock mandrel body (12). Shear pins (34) are adapted on downward jarring against a landing nipple to expand the keys (20) and shear pins (33) are adapted on upward jarring to release the running tool. The running tool has a 'tell-tale' collet (30), connected to it by a shear pin (32), to indicate that the lock mandrel is correctly set in the landing nipple, said collet being adapted when the running tool (11) is released from the lock mandrel (10) after setting the lock to disengage intact from the lock mandrel (10) if the lock-out keys (20) are correctly set and to foul the inner mandrel and shear the shear pin (32) if the lock-out keys are incorrectly set. The inner mandrel (13) is resiliently urged in an upward direction, i.e. in the direction of flow from the well, to actuate the lock-out keys (20) to set the lock, and latch means (22) is provided to hold the inner mandrel in a downward disposition against its resilient means prior to setting the lock.

8 Claims, 4 Drawing Sheets

DOWNHOLE LOCK ASSEMBLY

This invention relates to a downhole lock assembly for use in oil and water/gas well operations, and comprises in combination a lock mandrel and a running tool.

Downhole lock assemblies are known, in which the lock mandrel is used in conjunction with different accessories which are required for well control in downhole oil, water/gas well operations, being used to anchor and seal the accessory in position in the well tubing string.

The accessory is attached to the lower end of the lock mandrel, which is tubular, and the running tool is located within the lock mandrel from the upper end.

The lock mandrel with accessory is run in and positioned in the well by the running tool which primarily holds an inner mandrel (located within the main body of the lock mandrel) in a position allowing lock-out keys (or dogs) of the lock mandrel to remain within the outside diameter of the main body.

On reaching the setting depth down the tubing, the lock mandrel stops against a restriction in the tubing known as the no-go, and by jarring downwards to shear pins, the lock is set, i.e. the inner mandrel moves to expand the lock-out keys into a machined profile (known as the landing nipple) in the tubing. By jarring upwards and shearing other pins the running tool is released from the set lock mandrel and retrieved. The running tool has a 'tell-tale' device which gives an indication of the correct setting of the lock mandrel. Hereinafter such a downhole lock assembly will be referred to as an assembly of the type aforesaid.

The lock mandrel and accessory can be retrieved after use.

An object of this invention is to provide an improved assembly of the type aforesaid.

According to one aspect of the present invention there is provided a downhole lock assembly of the type aforesaid, in which the inner mandrel is resiliently urged in an upward direction, i.e. in the direction of flow from the well, to actuate the lock-out keys to set the lock, and latch means is provided to hold the inner mandrel in a downward disposition against its resilient means prior to setting the lock, and in which the running tool carries a tell-tale collet mens connected thereto by a shear pin, said collet means being adapted when the running tool is released from the lock mandrel after setting the lock to disengage intact from the lock mandrel if the lock-out keys are correctly set and to foul the lock-out mandrel and shear the shear pin if the lock-out keys are incorrectly set.

According to another aspect of the present invention there is provided, a lock mandrel comprising a hollow cylindrical main body which in use is vertical, and a hollow cylindrical inner mandrel slidably located at the inner periphery of the main body, said inner mandrel being resiliently urged in an upward direction to actuate a plurality of lock-out keys carried in windows in the main body and laterally adjustable between an inner position in which the keys are confined within the outside diameter of the main body and an outer position in which the keys project laterally from the main body, and latch means to locate the inner mandrel in a downwardly disposed position against its resilient means wherein the keys are in their inner position, and means on the inner mandrel to extend the keys laterally outwards when the latch means is released and the inner mandrel moves upwards under its resilient means.

Preferably, said latch means comprises longitudinally extending finger means on the external face of the inner mandrel, biassed laterally inwards but for location in groove means in the inner face of the main body, there being upper and lower grooves, said finger means being adapted to locate in the lower groove to latch the inner mandrel in its downward disposition and to locate in the upper groove when the keys are correctly set or to extend inwardly beyond the inside diameter of the inner mandrel if the keys are incorrectly set, thereby to foul the collet means on the running tool during release thereof.

Preferably also, the collet means on the running tool comprises a plurality of longitudinal extending fingers adapted to pass upwardly through the inner mandrel undamaged if the finger means of the latch are located in the upper groove of the main body and to strike said finger means if said finger means are not so located out of the path of the collet means.

An embodiment of the present invention will now be described, by way of example, with reference to the accompanying drawings, in which.

Figure 1:
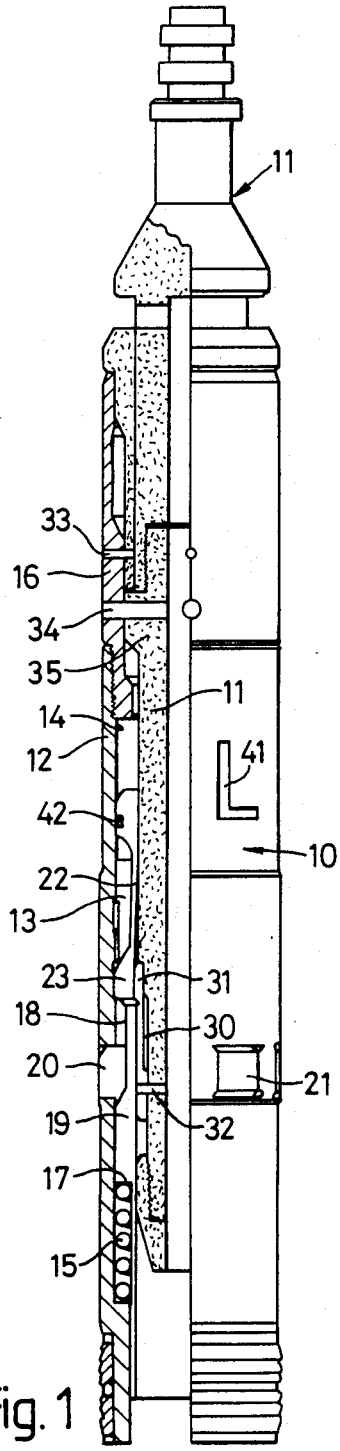
FIG. 1 is a part sectional elevation of a downhole lock assembly according to the invention in the 'running' mode.

Referring to the drawings, the downhole lock assembly comprises, in combination, a lock mandrel 10 and a running tool 11.

The lock mandrel comprises a hollow cylindrical main body 12 within which is a hollow cylindrical inner mandrel 13 slidably located against the inner face 14 of the main body 12.

The inner mandrel is urged by coil spring 15 carried within the main body 12 towards one end thereof, namely the upper end in use. The (upper) end of the main body 12 terminates in a fishing neck 16 by which the lock mandrel can be connected to the running tool 11 as hereinafter described, and also to a retrieving probe, also as hereinafter described.

Figure 2:
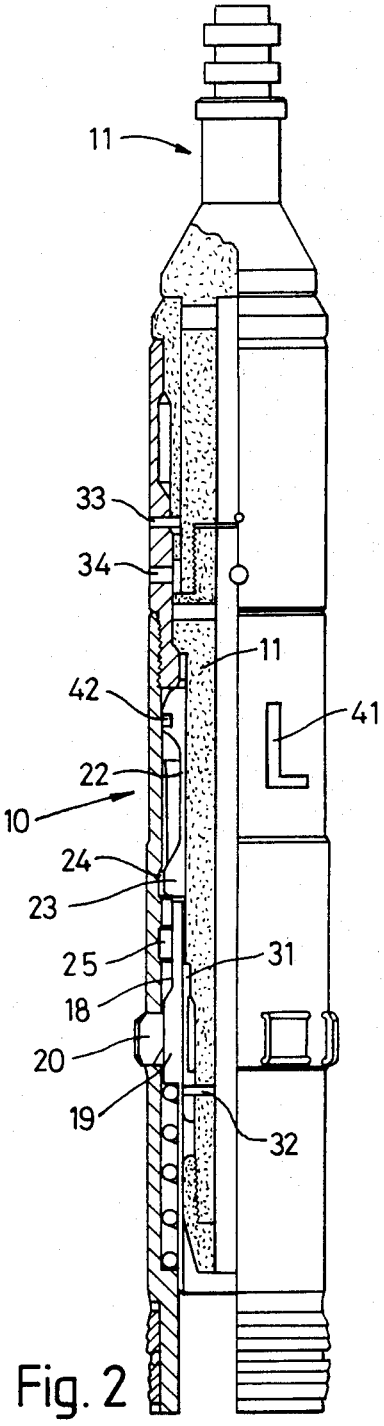
FIG. 2 is a similar view of the assembly in the 'setting' mode.

The spring 15 engages the lower end face 17 of the inner mandrel 13 which has a waist 18 from its lower end portion 19. The waist 18 and lower end portion 19 are selectively intended to engage a series of radial lock-out keys or 'dogs' 20 carried in windows 21 in the main body 12. Thus, when the inner mandrel 13 is spring urged to an upper position (wherein it abuts the fishing neck 16), the keys 20 are extended outwards and held out by the end portion 19 (FIG. 2). When the inner mandrel is forced downward to a lower position, the keys 20 retract inwardly to lie within the outside diameter of the main body 12 (FIG. 1), within waist 18.

The inner mandrel 13 has at its upper end a pair of downwardly extending fingers 22, the lower ends 23 of which, in their natural disposition, project inwardly beyond the inside diameter of the inner mandrel, while lying flush with the outside diameter. These finger ends 23 are intended to locate selectively in one of two transverse grooves 24, 25 in the inner face of the main body 12 but pressure from within the inner mandrel is required to locate the finger ends in one or other of the grooves.

When the fingers are not engaged in groove 24 or 25, they will be subject to contact by the running tool 11 as it enters into or is withdrawn from the lock mandrel. During entry, the running tool will slide against the fingers 22 and urge them outwards into the appropriate groove 25 provided the finger ends 23 are lined up with the groove.

Therefore, before the running tool 11 is run downwards into the lock mandrel, the lock mandrel is 'cocked' by pushing or drawing down the inner mandrel to its lower position so that the finger ends are lined up with the lower groove 25. The procedure is hereinafter explained, but once the lock mandrel is cocked, the running tool 11 locates in the lock mandrel 10 extending to adjacent the lower end thereof (FIG. 1).

Figure 8:
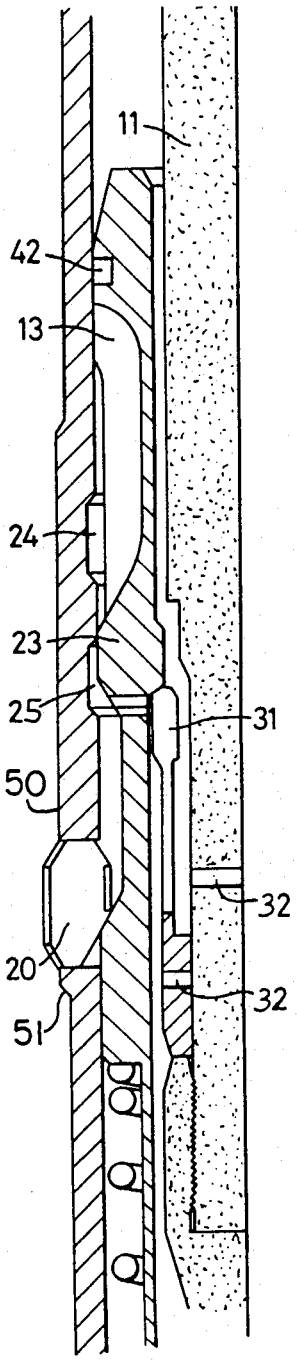
FIG. 8 is a similar part sectional elevation showing a detail.

The running tool carries adjacent to its lower end, a tell-tale collet 30 which comprises a series of upwardly extending fingers 31 radially outwardly biassed. These fingers 31 engage the finger ends 23 of the inner mandrel and urge the latteer into groove 25 to secure the inner mandrel in its lower position as seen in FIG. 1. The collet 30 is attached to the running rool by a shear pin 32 such that, if the finger ends 23 of the inner mandrel are not correctly engaged in the upper groove 24 when the running tool is withdrawn, the fingers 23 will foul the collet 30 and cause the shear pin to shear (FIG. 8).

Once the running tool is fully located within the lock mandrel, two sets of longitudinally spaced shear pins 33, 34 are inserted through co-axial bores in the fishing neck 16 and a shear off sub portion 35 of the running tool 11. The lower pins 34 (e.g. ¼" diameter) are intended to shear on a downward jar and the pins 33 (e.g. 5/16" diameter) to shear on an upward jar.

The shear pins may be brass or steel as desired.

Operation of the downhole lock assembly will now be described.

The lock mandrel 10 with an accessory secured to its lower end is run in and positioned in a well (not shown) by means of the running tool 11. This running tool primarily holds the inner mandrel 13 in the downward position allowing the lock-out keys 20 to remain within the major O.D. of the main body 12.

On reaching the setting depth, the lock mandrel will stop against a restriction (not shown) in the tubing bore (not shown), known as the 'no-go', and by jarring downwards to shear pins 34 the lock mandrel is set, i.e. the inner mandrel moves upwards and expands the lock-out keys 20 into a machined profile (known as the landing nipple) in the tubing. Finger ends 23 move upwards into groove 24.

By jarring upwards the shearing other pins 33, the running tool 11 is released from the set lock and retrieved.

An indication of correct setting of the lock out keys 20 is given by the positive tell-tale device (collet 30) incorporated in the running tool 11.

To retrieve the lock and accessory a probe 40 (FIGS. 4 and 5) is run in conjunction with a standard GS type wireline pulling tool, which latches the internal fishing neck 16 of the lock mandrel 10. Simple upward jarring will release the lock mandrel from the nipple.

Running Procedure FIG. 1.

Before insertion of the running tool, the lock mandrel 10 must be 'cocked' into the running mode. This is done by inserting a punch (not shown) into an 'L' -slot 41 in the main body 12, and locating a groove 42 on the inner mandrel. By pulling the punch down and locking it, in the bottom of the 'L' slot, the inner mandrel 13 is moved to the running position with the finger ends 23 projecting into the lower groove 25 in the inner face of the main body 12.

Alternatively the inner mandrel can be pushed into place using the pulling probe 40 and an extension handle. By holding down, the inner mandrel can be locked into position again using the punch in the 'L' slot.

Figure 3:
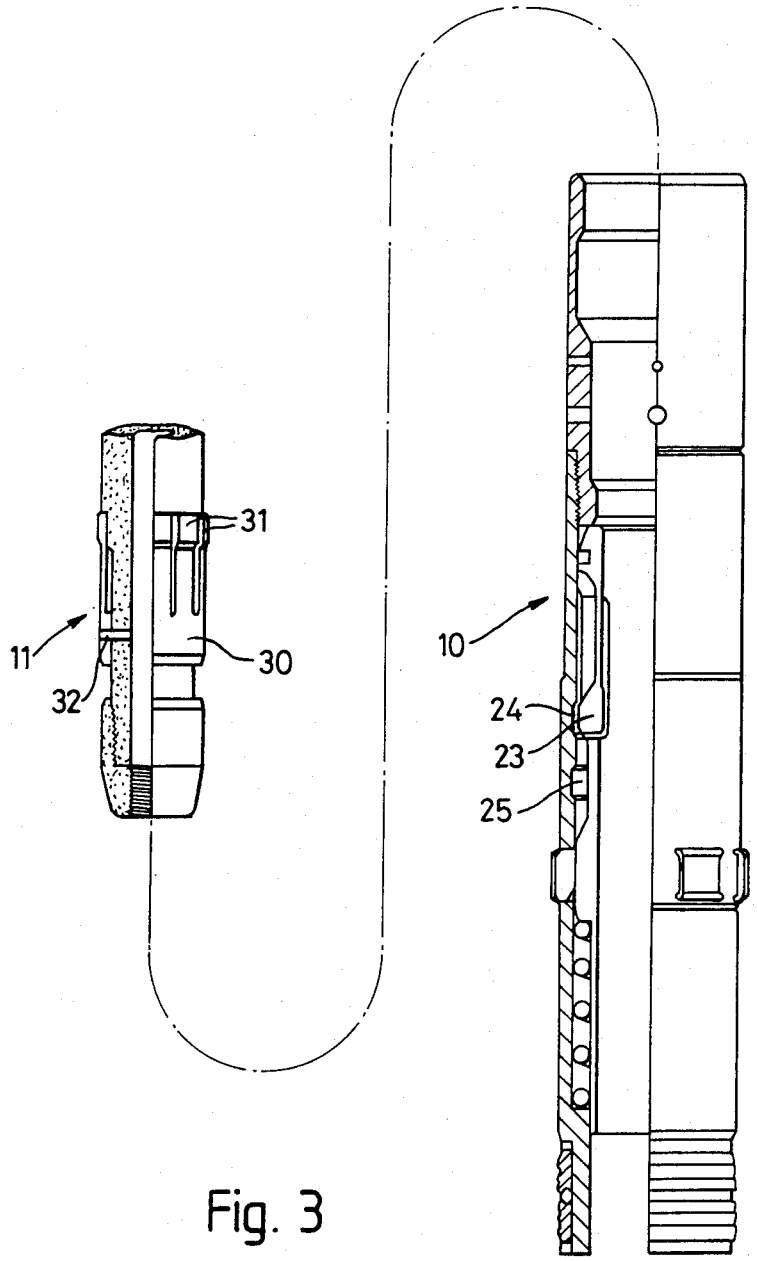
FIG. 3 is a similar view of the assembly in the 'set' mode with the running tool disengaged from the lock mandrel.
Figure 6:
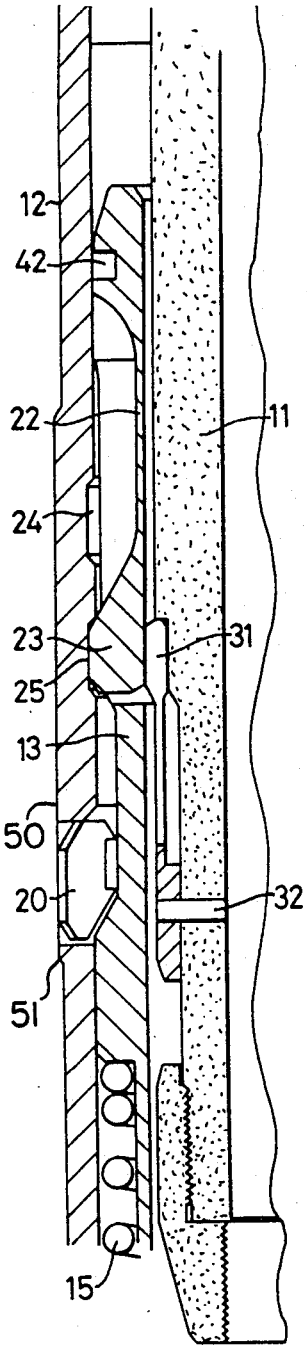
FIG. 6 is a part sectional elevation to a larger scale of a portion of FIG. 1.

With the punch locked in the bottom of the 'L' slot (maintaining the inner mandrel in the running position) the running tool, can now be inserted into the lock mandrel ensuring that the tell-tale collet 30 is pinned to the running tool in the 'up' position as shown in FIG. 3. The finger ends 23 of the inner mandrel 13 are engaged from behind by the fingers 31 of the collet and pressed firmly into the lower groove 25 thereby to hold back the mandrel in the lower (running) position, FIG. 6.

It should be noted that the punch is kept in the 'L' slot until the lock mandrel 10 is pinned to the running tool 11, by the two sets of shear pins 34, 33.

When the punch is removed from the 'L' slot the inner mandrel remains in the running position with the lock out keys retracted.

The lock assembly is now ready to run, as shown in FIG. 1.

Setting the Lock FIG. 2.

Figure 7:
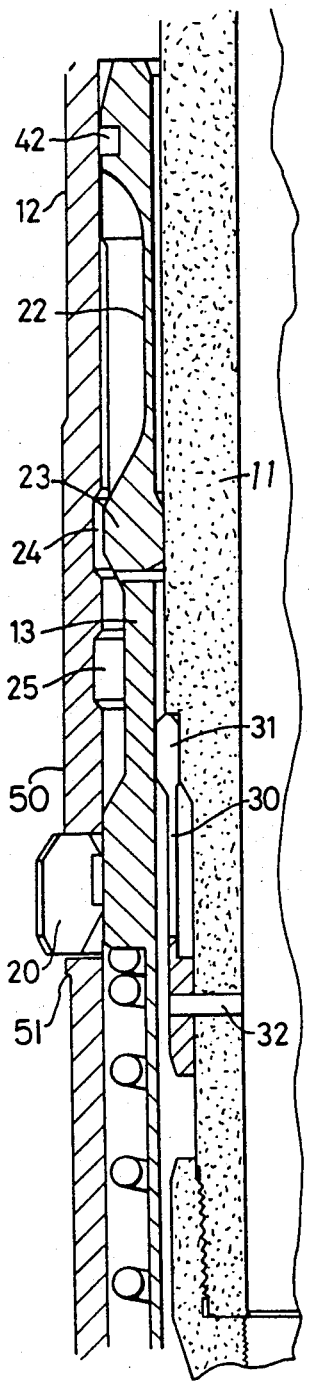
FIG. 7 is a similar view of a portion of FIG. 2.

The lock mandrel has a no-go shoulder 50 which has a step 51 positioned just below the lock out key windows 21. The step 51 no-goes on a nipple landing (not shown). By jarring down the setting pins 34 will be sheared. The fingers 22 on the inner mandrel 13 are then allowed to retract and the mandrel will, under the action of spring 15 and aided by the collet 30 on the running tool, move upwards to expand the lock-out keys 20 (FIG. 7).

The running tool is released from the lock by upward jarring, see FIGS. 2 and 3.

Tell-Tale on Running Tool FIG. 8.

If the shear pin 32 on the tell-tale collet 30 remains intact when the running tool 11 is pulled out, this will indicate that the lock is properly set. If the tell-tale shear pin 32 has sheared then the lock will not be properly set and will have to be retrieved. For example, scale in the nipple profile would not allow lock-out keys 20 to expand fully.

Figure 4:
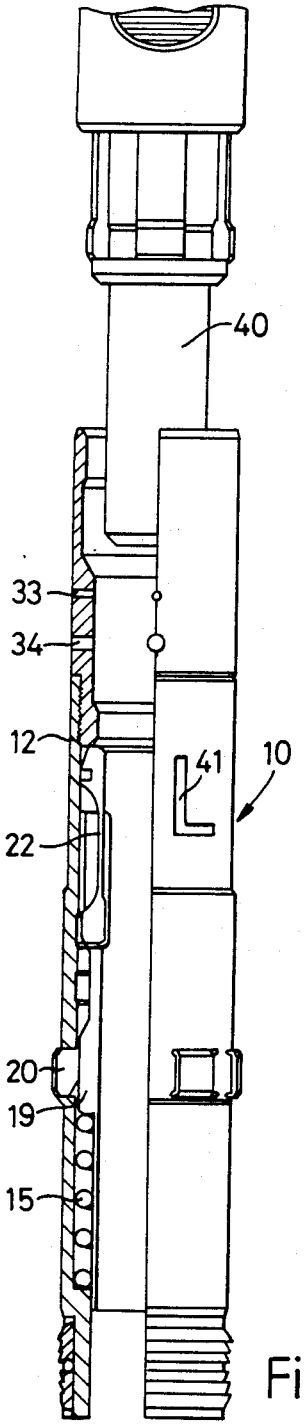
FIG. 4 is a part sectional elevation of the lock mandrel and probe means for retrieving the lock mandrel.
Figure 5:
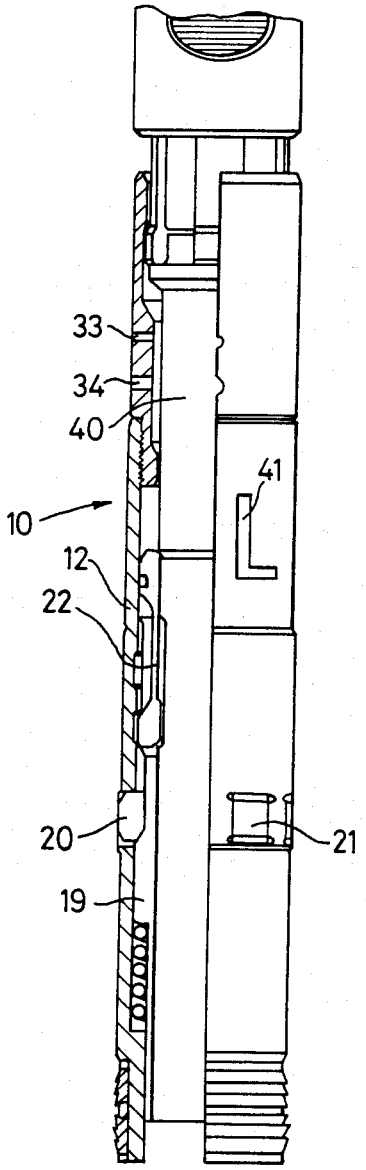
FIG. 5 is a similar view showing the lock mandrel being pulled.

Retrieving the Lock Mandrel FIGS. 4 and 5.

The lock mandrel is retrieved using a 4" pulling tool run with probe 40 which latches on to the fishing neck 16. Once latched the lock mandrel is released from the nipple by simply jarring up.

A further important aspect of the lock is its use for high pressure application.

On high pressure equipment the lock mandrel 10 stops against the no-go and by jarring downward to shear pins 34, the inner mandrel 13 is released. The lock-out keys 20 at this stage are not in line with the machine profile and cannot expand until the lock mandrel has been lifted from the no-go. By upward movement of the running tool 11, the lock mandrel is lifted from the no-go and the lock-out keys 20 expand into the machined profile. The lock mandrel is then correctly set supported by the keys 20 only, which are designed to hold greater differential pressures. By jarring upwards and shearing pins 34, the running tool 11 is released. The running tool has the same tell tale collet 30 which performs the same function.

All other aspects of the lock assembly are the same, the only difference being this lifting of the lock mandrel from the no-go and pressure holding keys.

A downhole lock assembly as hereinbefore described is advantageous in several respects, such as the simplicity of design. Also, when the inner mandrel operates to lock out the keys it moves in the direction of flow from the well. It has a smooth through bore which assists.

In the described embodiment the fingers on the inner mandrel and tell-tale collet extend downwardly and upwardly respectively but these dispositions can be reversed for other constructions without altering the principal of operation.

Finally, the tell-tale collet will positively shear if the lock mandrel has not correctly locked, giving a positive visual indication when the running tool is inspected after removal from the tubing.

I claim:

1. A downhole lock assembly comprising a lock mandrel connected to a running tool which holds an inner mandrel located within a body of the lock mandrel in a position which allows lock-out keys of the lock mandrel to remain within the outside diameter of the lock mandrel body, shear pins adapted on downward jarring against a landing nipple to expand the keys and shear pins adapted on upward jarring to release the running tool, said running tool having a tell-tale indicating device to indicate that the lock mandrel is correctly set in the landing nipple, the inner mandrel being resiliently urged in an upward direction in the direction of flow from the well, to actuate the lock-out keys to set the lock, and latch means being provided to hold the inner mandrel in a downward disposition against its resilient means prior to setting the lock, and said tell-tale indicating device including collet means carried by the running tool and connected thereto by a shear pin, said collet means being adapted when the running tool is released from the lock mandrel after setting the lock to disengage intact from the lock mandrel if the lock-out keys are correctly set and to foul the inner mandrel and shear the shear pin if the lock-out keys are incorrectly set said collet means adapted to remain on said running tool and be withdrawn with said running tool when said running tool is released from said mandrel when said lock-out keys are correctly set and also when said lock-out keys are incorrectly set.

2. A downhole lock assembly according to claim 1, wherein the lock mandrel comprises a hollow cylindrical main body which in use is vertical, and a hollow cylindrical inner mandrel slidably located at the inner periphery of the main body said inner mandrel being resiliently urged in an upward direction to actuate said plurality of lock-out keys carried in windows in the main body and laterally adjustable between an inner position in which the keys are confined within the outside diameter of the main body and an outer position in which the keys project laterally from the main body, and latch means is provided to locate the inner mandrel in a downwardly disposed position against its resilient means wherein the keys are in their inner position, and means on the inner mandrel is provided to extend the keys laterally outwards when the latch means is released and the inner mandrel moves upwards under its resilient means.

3. A downhole lock assembly according to claim 2, wherein said latch means comprises longitudinally extending finger means on the external face of the inner mandrel, biassed laterally inwards but for location in groove means in the inner face of the main body, there being upper and lower grooves, said finger means being adapted to locate in the lower groove to latch the inner mandrel in its downward disposition and to locate in the upper groove when the keys are correctly set or to extend inwardly beyond the inner side diameter of the inner mandrel if the keys are incorrectly set, thereby to foul the collet means on the running tool during release thereof.

4. A downhole lock assembly according to claim 3 wherein the collet means on the running tool comprises a plurality of longitudinally extending fingers adapted to pass upwardly through the inner mandrel undamaged if the finger means of the latch are located in the upper groove of the main body and to strike said finger means if said finger means are not so located out of the path of the collet means.

5. A downhole lock assembly as claimed in claim 3 wherein the fingers of the latch means include finger ends which locate in the respective grooves.

6. A downhole lock assembly according to claim 4 wherein the fingers of the latch means include finger ends which locate in the respective groove.

7. A lock mandrel comprising a hollow cylindrical main body which in use is vertical, and a hollow cylindrical inner mandrel slidably located at the inner periphery of the main body and resiliently urged in an upward direction to actuate a plurality of lock-out keys carried in windows in the main body and laterally adjustable between an inner position in which the keys are confined within the outside diameter of the main body and an outer position in which the keys project laterally from the main body, and latch means provided to locate the inner mandrel in a downwardly disposed position against its resilient means so that the keys are in their inner position, and means on the inner mandrel provided to extend the keys laterally outwards when the latch means is released and the inner mandrel moves upwards under its resilient means;

said latch means comprises longitudinally extending finger means on the external face of the inner mandrel, biassed laterally inwards but for location in groove means in the inner face of the main body, there being upper and lower grooves, said finger means being adapted to locate in one of said grooves to latch the inner mandrel in its downward disposition and to locate in the other of said grooves when the keys are correctly set or to extend inwardly beyond the inside diameter of the inner mandrel if the keys are incorrectly set.

8. A lock mandrel as claimed in claim 7 in that the fingers of the latch means include finger ends which locate in the respective groove.

* * * * *